United States Patent [19]

Hauser

[11] 4,143,973

[45] Mar. 13, 1979

[54] GEAR

[75] Inventor: Hans Hauser, Fredericktown, Ohio

[73] Assignee: The J. B. Foote Foundry Co., Fredericktown, Ohio

[21] Appl. No.: 855,368

[22] Filed: Nov. 28, 1977

[51] Int. Cl.[2] ..... B01F 11/00

[52] U.S. Cl. ..... 366/54; 74/449; 74/DIG. 10

[58] Field of Search ..... 366/45, 48, 54; 74/DIG. 10, 443, 445, 461, 434, 805

[56] References Cited

U.S. PATENT DOCUMENTS

| | | | |
|---|---|---|---|
| 2,470,100 | 5/1949 | Heine | 366/54 |
| 3,225,616 | 12/1965 | Whitehead | 74/449 |
| 3,361,004 | 1/1968 | Williams et al. | 74/DIG. 10 |

*Primary Examiner*—Leonard D. Christian
*Attorney, Agent, or Firm*—Allen D. Gutchess, Jr.

[57] ABSTRACT

A composite gear of metal and plastic is provided and specifically a composite ring gear for a cement mixer. The ring gear for rotating the mixing drum of a cement mixer is commonly formed by stamping teeth in a metal flange circumjacent an intermediate portion of the mixing drum. Such gears have been noisy and lack impact resistance. The new ring gear comprises a metal flange to which is affixed a plurality of arcuate gear segments of a plastic material having gear teeth formed therein. The teeth of the plastic segments mesh with a drive pinion gear. The composite gear is much quieter and is also more impact resistant during operation. The segments can also be inexpensively and readily replaced, if necessary.

6 Claims, 8 Drawing Figures

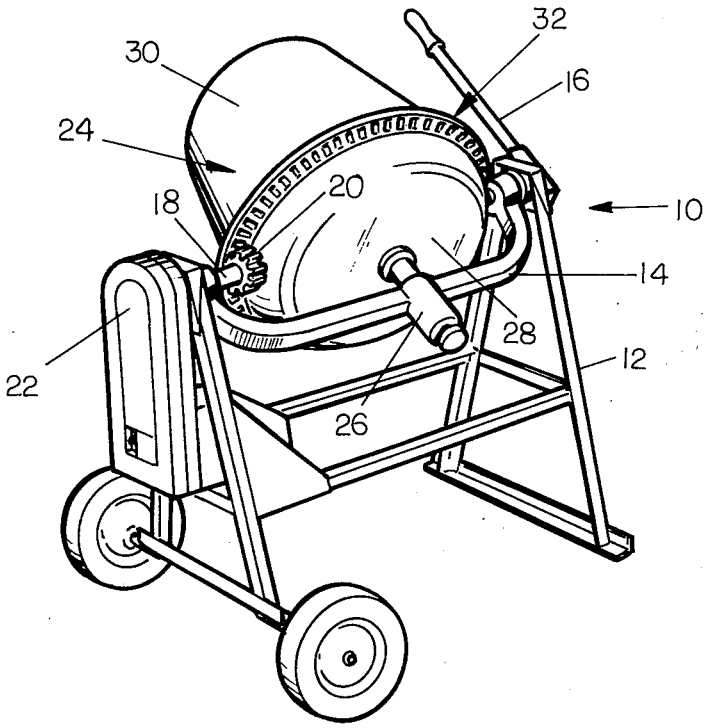

40
42
44
46
48
50
54
56
58
60
62
64
4
6
7
8

GEAR

This invention relates to a composite gear and, specifically, to a composite ring gear of metal and plastic for cement mixers.

Some commercially-available cement mixers have bolted-on cast iron or aluminum gears or such gears cast in one piece with the bottom section of the mixing drum. Others have a mixing drum made in two sections, one of which has an outwardly-extending flange which extends circumjacent an intermediate portion of the mixing drum when the two sections are assembled. Gear teeth are stamped in this metal flange to form an annular ring gear for rotating the mixing drum when the ring gear is driven by a pinion gear. The stamped gear teeth and the cast metal ones are not precision formed and have less accurate tooth forms. This, along with the metal-to-metal contact of the ring gear teeth and pinion gear teeth, results in a very noisy operation when the cement mixer is operated.

The present invention provides an improved gear and specifically a composite ring gear for a cement mixer. In accordance with the invention, the ring gear includes a circumjacent metal flange around the mixing drum of the cement mixer in the same manner as before. However, in a preferred form, the flange is toothless and has an outer circular lip which provides additional strength and stiffness for the flange. A plurality of plastic gear segments are affixed to the lower surface of the metal flange. These gear segments have a multiplicity of teeth therein which are more accurately formed as gear teeth than those heretofore cast or stamped in the metal flange itself. Further, the segments are overlapping to provide a smooth transition from the end of one segment to the beginning of the next. The gear teeth, being of somewhat resilient plastic and more accurately formed, with smoother surfaces, result in a much quieter operation for the cement mixer. Further, the plastic teeth, particularly when provided with connecting flanges or webs, provide a degree of impact resistance for the mixer not heretofore achieved with the metal flange teeth. The gear teeth segments are also initially low in cost and are relatively easy and less expensive to replace, if necessary.

It is, therefore, a principal object of the invention to provide a composite gear having a metal member to which plastic gear teeth are affixed.

Another object of the invention is to provide a cement mixer with a ring gear which is more quiet and impact resistant.

Still another object of the invention is to provide a composite ring gear, for a cement mixer, which gear is initially low in cost and is easier and less expensive to replace.

A further object of the invention is to provide a cement mixer with a composite ring gear comprising a metal flange circumjacent an intermediate portion of the mixing drum and a plurality of plastic gear segments affixed to the metal flange and having teeth extending away therefrom.

Many other objects and advantages of the invention will be apparent from the following detailed description of a preferred embodiment thereof, reference being made to the accompanying drawings, in which.

Figure 1:
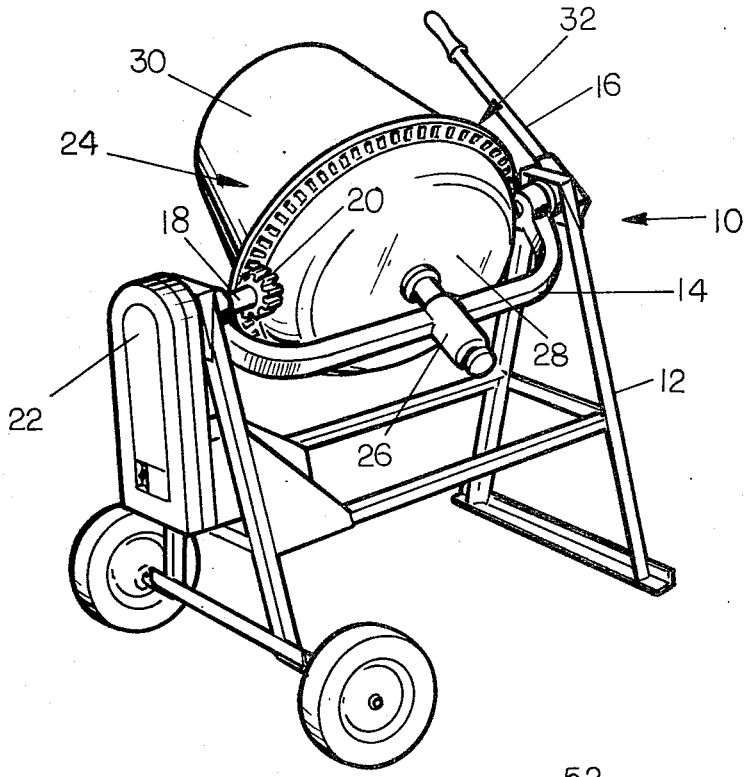
FIG. 1 is a rear view in perspective of a cement mixer having a ring gear in accordance with the invention.

Referring particularly to FIG. 1, a small cement mixer as used by contractors and home owners is indicated at 10. Typically, the mixer 10 has a capacity of anywhere from one-half to about five cubic yards and is designed to be moved about, either by hand, or by a vehicle. The cement mixer 10 includes a main frame 12 which pivotally supports a drum yoke 14. At one end, the yoke has a pivot axle connected to a crank arm 16 which can be manipulated to pivot the yoke 14. At the other end, the yoke is pivotally supported on a drive shaft 18 which is rotatably carried by an upper end portion of the frame and has a pinion gear 20 affixed thereto. The pinion gear and shaft are driven by a sheave (not shown) located within a motor housing 22. The sheave is engaged by a V-belt which is driven by a drive sheave located in a lower portion of the housing 22. A motor in the housing 22 is supported through a portion of the frame and rotates the drive sheave.

Figure 2:
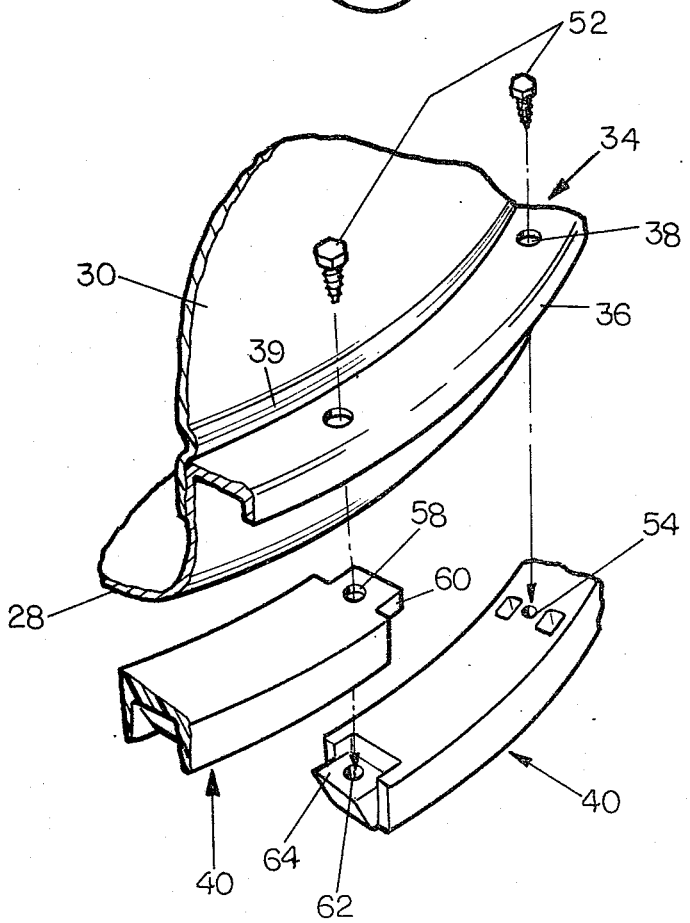
FIG. 2 is a fragmentary, exploded view in perspective of the ring gear of FIG. 1.

A mixing drum 24 is rotatably mounted on an intermediate portion of the yoke 14 by means of a bearing and axle assembly 26. The mixing drum 24 is made in two portions or sections, including a concave bottom section 28 and a truncated-conical mouth section 30 into which the cement and other ingredients are fed. A circular ring gear embodying the invention is indicated at 32 and is circumjacent an intermediate portion of the mixing drum 24. As shown in FIG. 2, the ring gear includes a metal flange 34 which is structurally integral with the bottom section 28 of the drum 22, although it could be structurally integral with the mouth section 30 or welded to either. The flange 34 has an outer downwardly-extending lip 36 thereon to provide additional stiffness and rigidity for the flange, and the flange also has a plurality of fastener openings 38 equally spaced therearound. The mouth section 30 of the drum has a continuous bead 39 therearound which helps to position the sections when being assembled, prior to welding. The bead also eliminates any gap otherwise existing at the mating portions of the two sections 28 and 30.

Gear tooth segments 40, in this instance there being five, are affixed to the lower surface of the flange 34. Referring particularly to FIGS. 2-8, each of the segments 40 includes a plurality of V-shaped gear teeth 42 extending away from the flange 34 with generally V-shaped recesses 44 at the back of the segments. Truncated V-shaped notches or recesses 46 are located between the teeth to receive the teeth of the pinion gear 20. Each of the segments 40 also has arcuate continuous end flanges or connecting webs 48 and 50 at the ends of the teeth 42 to provide additional strength and rigidity for the teeth, along with greater impact resistance.

The teeth 42 are more dimensionally accurate and closely formed to the true gear tooth form as compared to the teeth stamped out of the metal flanges heretofore employed. The plastic teeth also exhibit a degree of resiliency and have smooth outer surfaces. These factors render the plastic teeth much quieter when meshing with the metal teeth of the pinion gear 20. The teeth are preferably made of a glass-filled, nylon alloy which, along with the connecting flanges 48 and 50 and the metal backing flange 34, enable the teeth to have high impact resistance. In addition, if any of the teeth become damaged, the individual gear segments 40 can be readily replaced and replacement is much less expensive.

The segments 40 are affixed to the metal flange 34 by fasteners 52 (FIG. 2) which can be in the nature of sheet metal screws. The fasteners 52 extend through the holes 38 and into fastener bores or recesses 54 (FIGS. 3–5) located at intermediate portions of each of the gear segments 40 with side recesses 56 on each side of the bores 54.

Figures 3, 4, 5, 6, 7, 8:
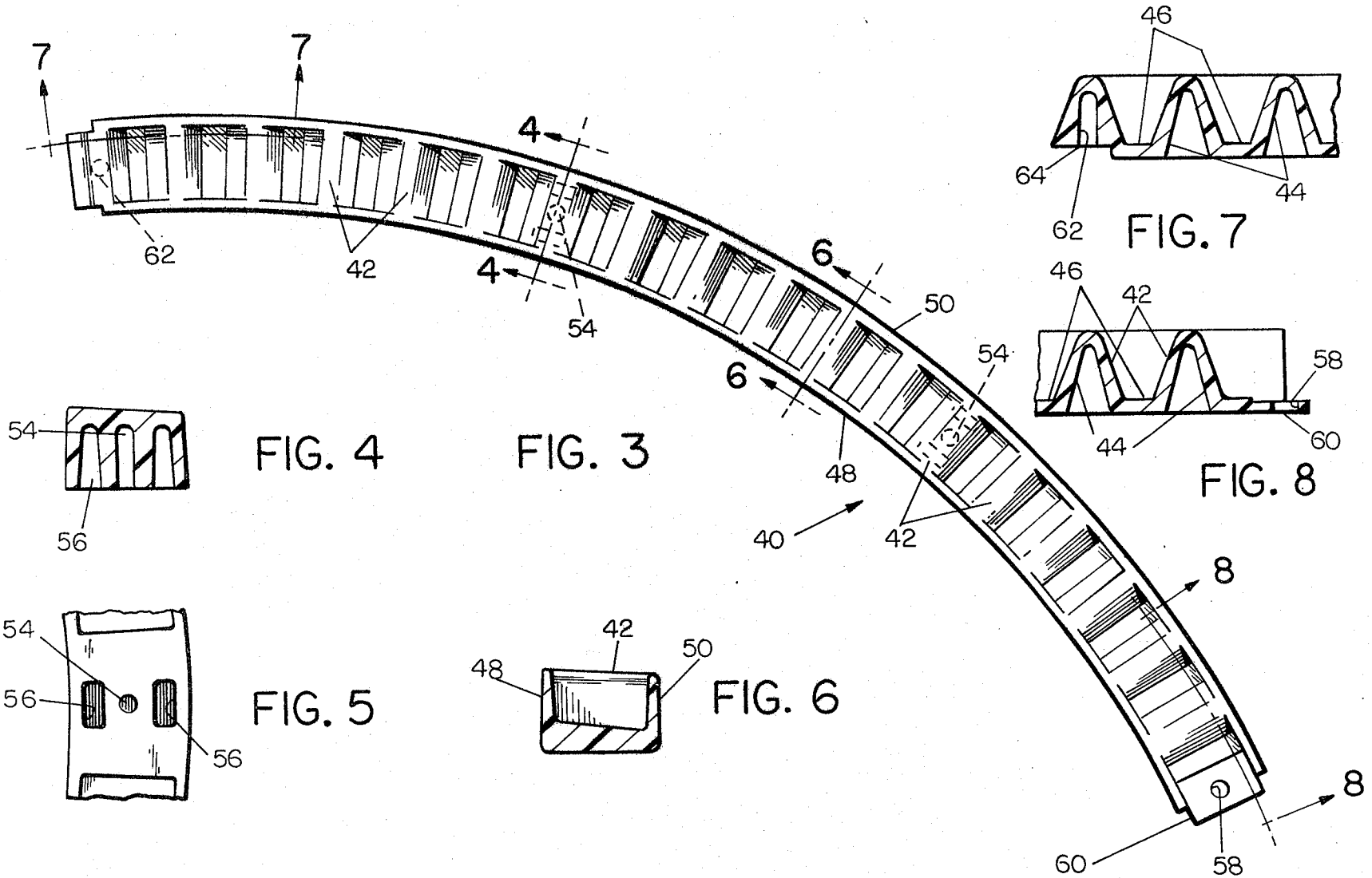
FIG. 3 is a view from below of a plastic ring gear segment.
FIG. 4 is a view in transverse cross section taken along the line 4—4 of FIG. 3.
FIG. 5 is a fragmentary back view of the portion of the ring gear segment shown in FIG. 4.
FIG. 6 is a view in transverse cross section taken along the line 6—6 of FIG. 3.
FIG. 7 is a fragmentary view in longitudinal cross section taken along the line 7—7 of FIG. 3.
FIG. 8 is a fragmentary view in longitudinal cross section taken along the line 8—8 of FIG. 3.

At the right end of each of the segments 40, as viewed in FIG. 3, the fastener 54 also extends through an opening 58 in an end tab 60 and into an additional fastener bore 62 (FIG. 7) located in the left end of the next gear segment. This end of each of the gear segments 40 also has a shallow recess or offset 64 which receives the end tab 60 so that the segments 40 are maintained in accurate, overlapping, end-to-end relationship. With this arrangement, each of the gear segments 40 is affixed to the lower surface of the metal flange 34 by four of the fasteners, which is sufficient to prevent any creeping of the gear segments 40 relative to the flange 34.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A cement mixer comprising a mixing drum having a circumjacent metal flange extending outwardly around a middle portion of said drum, a plastic ring affixed to one side of said metal flange and extending around the entire periphery thereof, said plastic ring having a multiplicity of gear teeth extending away from said metal flange, said plastic ring comprising a plurality of segments, and means for affixing each of said segments to said flange and the ends of said segments together.

2. A cement mixer comprising a mixing drum having a circumjacent metal flange extending outwardly around a middle portion of said drum, a plastic ring affixed to one side of said metal flange and extending around the entire periphery thereof, said plastic ring having a multiplicity of gear teeth extending away from said metal flange, said plastic ring comprising a plurality of segments, said segments having recesses at intermediate and end portions thereof, and fasteners extending through said flange and received in said recesses.

3. A composite gear comprising a metal member having a predetermined, fixed diameter, a plastic member affixed to one side of said metal member and extending around the entire periphery thereof, said plastic member having a multiplicity of gear teeth extending away from said metal member, said plastic member being made of a plurality of segments, each of which is affixed to said metal member, one end of each said segments having a longitudinally-extending flange and the other end of each of said segments having a longitudinally-extending recess to receive the flange of an adjacent segment.

4. A gear according to claim 3 characterized by fasteners extending through said metal member, said longitudinally-extending flanges, and into the recessed ends of said segments.

5. A gear according to claim 3 characterized by said longitudinally-extending flanges having fastener openings therein and the recessed ends of said segments having fastener recesses extending transversely of the longitudinally-extending recesses, and fasteners extending through said metal member, said flange openings, and into said fastener recesses.

6. A composite gear comprising a metal member having a predetermined, fixed diameter, a plastic member affixed to one side of said metal member and extending around the entire periphery thereof, said plastic member having a multiplicity of gear teeth extending away from said metal member, said plastic member being made of a plurality of segments, each of which is affixed to said metal member, said plastic segments having side flanges extending along the teeth thereof at common ends of said teeth.

* * * * *